US010066421B2

(12) United States Patent
Strassburger et al.

(10) Patent No.: US 10,066,421 B2
(45) Date of Patent: Sep. 4, 2018

(54) FOOTWEAR SECURITY DISPLAY HANGER

(71) Applicant: B&G Plastics, Inc., Union, NJ (US)

(72) Inventors: Jacob Strassburger, South Plainfield, NJ (US); Michael Norman, East Brunswick, NJ (US); Keith Cedro, Ho Ho Kus, NJ (US)

(73) Assignee: B&G PLASTICS, INC., Union, NJ (US)

( * ) Notice: Subject to any disclaimer, the term of this patent is extended or adjusted under 35 U.S.C. 154(b) by 0 days.

(21) Appl. No.: 15/712,300

(22) Filed: Sep. 22, 2017

(65) Prior Publication Data

US 2018/0087293 A1 Mar. 29, 2018

Related U.S. Application Data

(60) Provisional application No. 62/400,771, filed on Sep. 28, 2016.

(51) Int. Cl.

| | |
|---|---|
| ***A47F 7/08*** | (2006.01) |
| ***E05B 69/00*** | (2006.01) |
| ***B65D 73/00*** | (2006.01) |
| ***A47F 5/00*** | (2006.01) |

(52) U.S. Cl.

CPC ..... *E05B 69/003* (2013.01); *A47F 5/0006* (2013.01); *B65D 73/0064* (2013.01); *A47F 7/08* (2013.01)

(58) Field of Classification Search

USPC ..... 248/682, 686, 690, 692, 301, 308, 305, 248/306, 339; 211/34, 35, 38, 85.31, 211/113; 206/806, 349; 223/87, 85, 223/DIG. 1

See application file for complete search history.

(56) References Cited

U.S. PATENT DOCUMENTS

| | | | | |
|---|---|---|---|---|
| 3,698,607 | A * | 10/1972 | Batts | A47G 25/485 223/96 |
| 3,755,859 | A * | 9/1973 | Solari | A47G 25/48 223/85 |
| 3,790,045 | A * | 2/1974 | Rigel | A47G 25/743 211/85.3 |
| 4,634,005 | A * | 1/1987 | Kulzer | B65D 73/0064 206/349 |
| 4,714,156 | A | 12/1987 | Kolton et al. | |
| 4,765,467 | A | 8/1988 | Kolton et al. | |
| 4,768,649 | A | 9/1988 | Kolton et al. | |
| 4,930,692 | A | 6/1990 | Smilow et al. | |
| 5,110,019 | A | 5/1992 | Kolton et al. | |
| 5,123,577 | A | 6/1992 | Kolton et al. | |
| 5,222,638 | A | 6/1993 | Kolton et al. | |

(Continued)

*Primary Examiner* — Alfred J Wujciak

(74) *Attorney, Agent, or Firm* — Hoffmann & Baron, LLP

(57) ABSTRACT

A footwear security display hanger includes a generally flat body member, first and second hooks integrally connected to the body member, and first and second locking arms connected to the first and second hooks, respectively. The first and second hooks have a first open-ended hook cavity and a second open-ended hook cavity, respectively, for receiving a portion of footwear. The first and second locking arms are movable to overlie the first and second open-ended hook cavities and lock the first and second hooks to close the first and second open-ended hook cavities to prevent the footwear from being removed from the first and second hooks.

12 Claims, 5 Drawing Sheets

(56) References Cited

U.S. PATENT DOCUMENTS 5,328,065 A 7/1994 Kolton et al.
5,501,378 A 3/1996 Kolton et al.
5,582,387 A 12/1996 Kolton et al.
5,615,810 A * 4/1997 Kolton ..... A47G 25/483 223/85
5,620,118 A * 4/1997 Kolton ..... A47G 25/743 223/85
5,826,760 A 10/1998 Kolton et al.
5,857,597 A * 1/1999 Kolton ..... A47F 5/0006 150/131
5,988,462 A 11/1999 Kolton
6,073,758 A 6/2000 Webster et al.
6,206,253 B1 3/2001 Kolton et al.
6,264,077 B1 7/2001 Kolton et al.
6,561,358 B2 5/2003 Kolton et al.
7,143,892 B2 12/2006 Kolton et al.
7,448,520 B2 11/2008 Kolton et al.
7,762,511 B1 * 7/2010 Liebers ..... A47F 7/021 206/5
8,286,882 B2 10/2012 Norman et al.
8,308,291 B2 11/2012 Norman et al.
8,381,920 B2 * 2/2013 Chang ..... B65D 73/0064 211/113
8,651,344 B2 2/2014 Norman et al.
9,480,347 B2 11/2016 Strassburger et al.
9,585,496 B2 3/2017 Strassburger et al.
2003/0025056 A1 * 2/2003 Atchley ..... B25B 9/00 248/304
2008/0296242 A1 * 12/2008 Worden ..... A47F 5/0006 211/113
2016/0058209 A1 3/2016 Strassburger et al.
2017/0253408 A1 9/2017 Strassburger

* cited by examiner

FOOTWEAR SECURITY DISPLAY HANGER

CROSS REFERENCE TO RELATED APPLICATION

This application claims priority to U.S. Provisional Patent Application No. 62/400,771, filed on Sep. 28, 2016, the contents of which are incorporated herein by reference in its entirety.

FIELD OF THE INVENTION

The present invention relates to footwear display hangers, and more particularly, to footwear security display hangers to prevent mix-up of models and sizes of footwear products.

BACKGROUND OF THE INVENTION

In most retail footwear stores, thong-type footwear products such as flip-flops or sandals are commonly displayed for sale on shoe racks or hung on a hook or the like. Generally, the entire inventory of models and sizes of these footwear products are available in the showroom for customers. It is customary for the customers to try different models and sizes of their choices in the showroom. However, this presents an issue of mixing up of the footwear products since the footwear products are frequently scattered randomly on the showroom floor after the customers try them on. In addition, it is difficult to track each piece of the footwear products and can be stolen by the customers without security tags. The security tags can be enclosed in or attached to a variety of different devices, such as holder or housing, which accommodate the electronic tag and are used to attach the tags to an article. This also presents both manufacturing and assembling issues, which increase the cost and product complexity.

Accordingly, there is a need for an improved footwear security display hanger to prevent mix-up of models and sizes of footwear products and theft by consumers.

SUMMARY OF THE INVENTION

According to an embodiment of the present invention, a footwear security display hanger includes a generally flat body member, first and second hooks integrally connected to the body member, and first and second locking arms connected to the first and second hooks, respectively. The first and second hooks have a first open-ended hook cavity and a second open-ended hook cavity, respectively, for receiving a portion of footwear. The first and second locking arms are movable to overlie the first and second open-ended hook cavities and lock the first and second hooks to close the first and second open-ended hook cavities to prevent the footwear from being removed from the first and second hooks.

These and other aspects of the present invention will be better understood in view of the drawings and following detailed description.

DETAILED DESCRIPTION OF PREFERRED EMBODIMENTS

Figure 1:
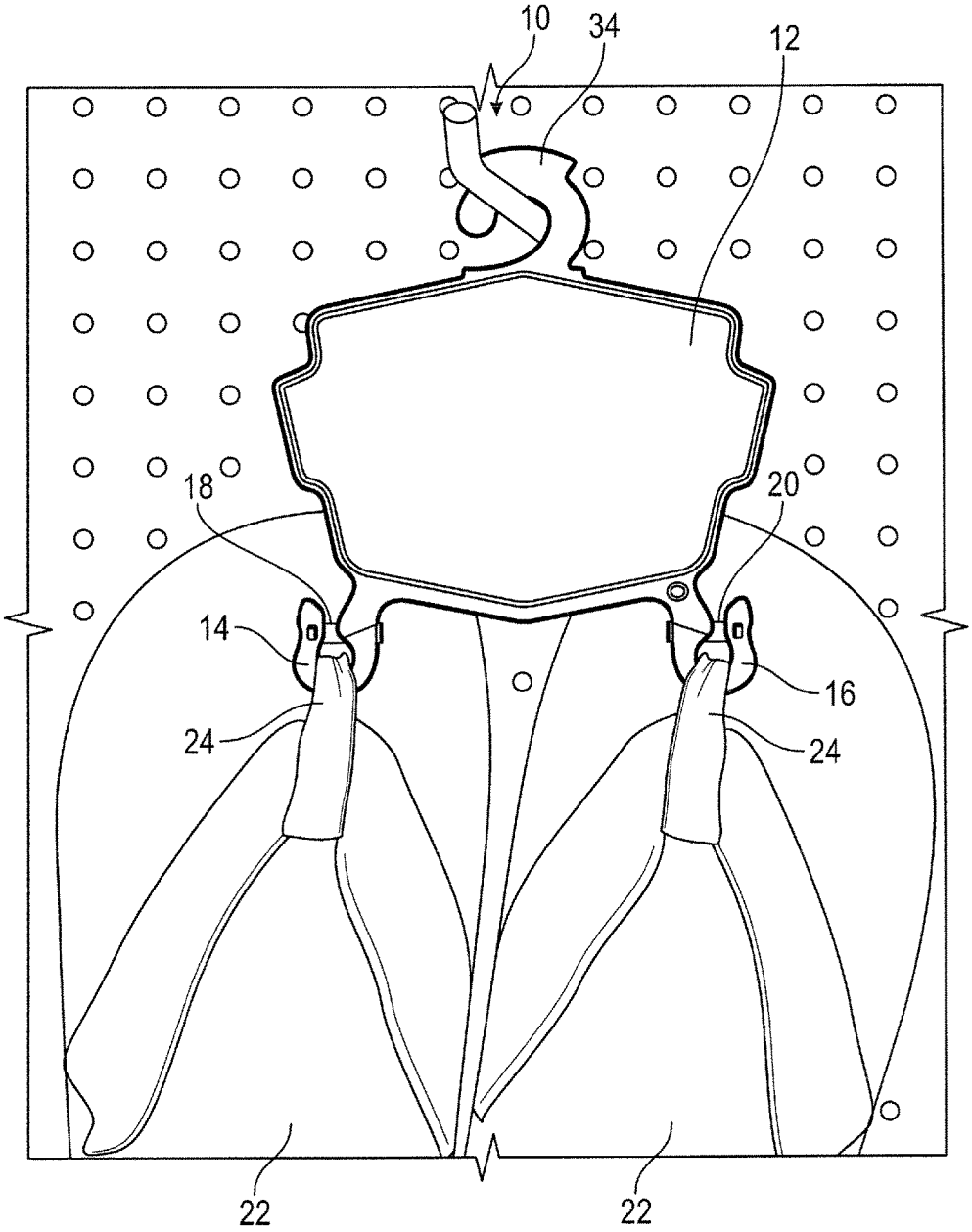
FIG. 1 is a front view of a footwear security display hanger, according to an embodiment of the present invention, with a footwear product secured thereonto.
Figure 2:
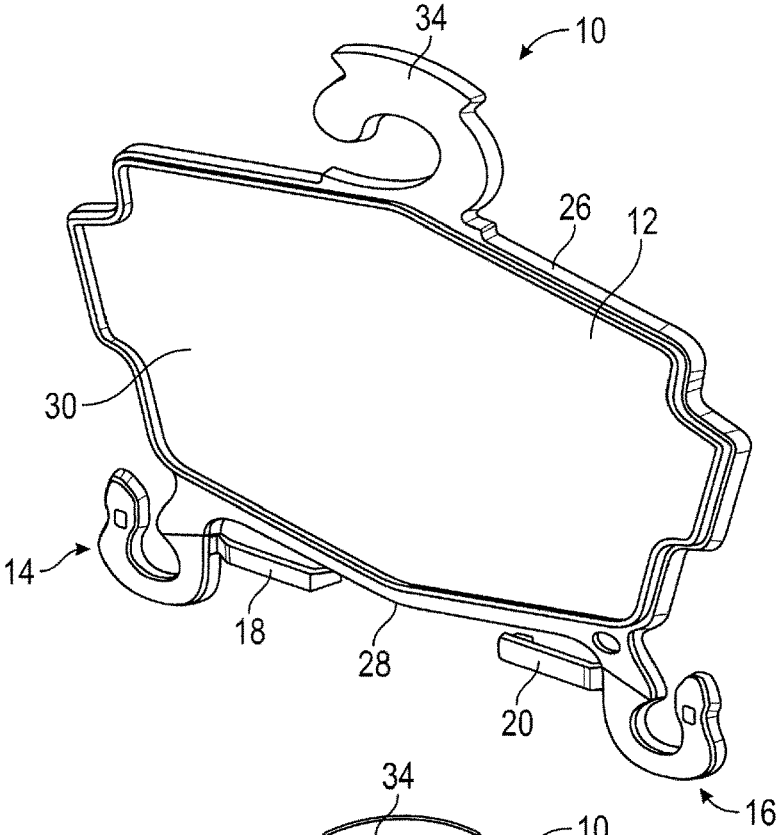
FIG. 2 is a perspective front view of the footwear security display hanger in an unlocked or open position.
Figure 3:
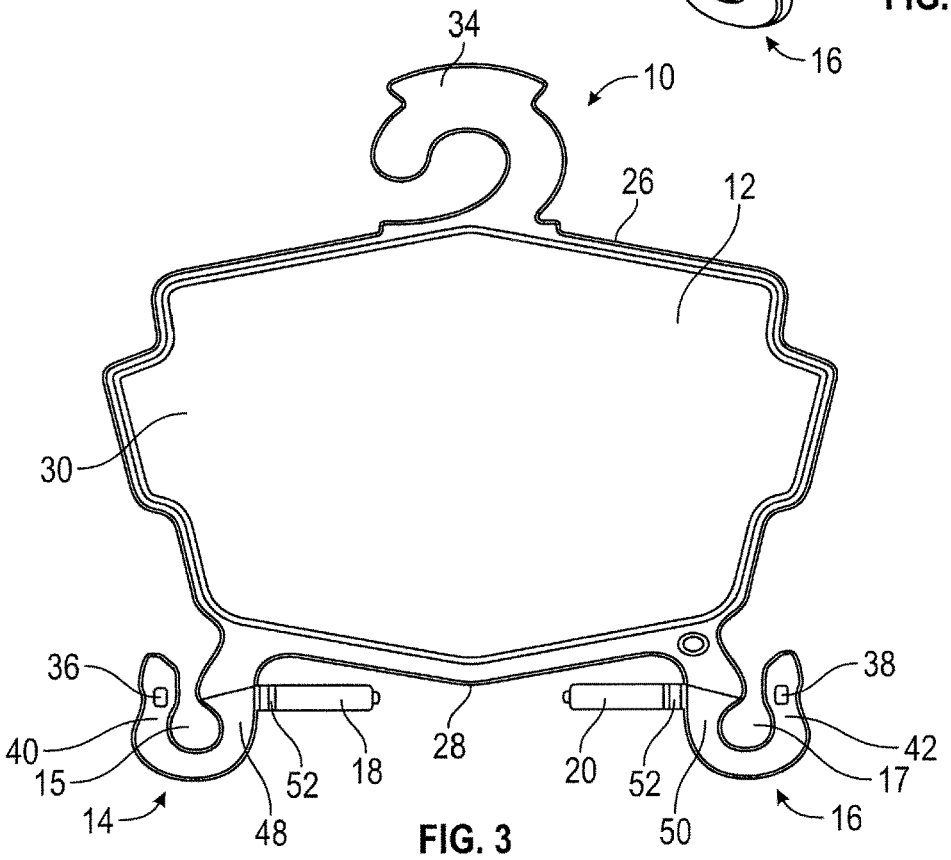
FIG. 3 is a front view of the footwear security display hanger in FIG. 2.
Figure 4:
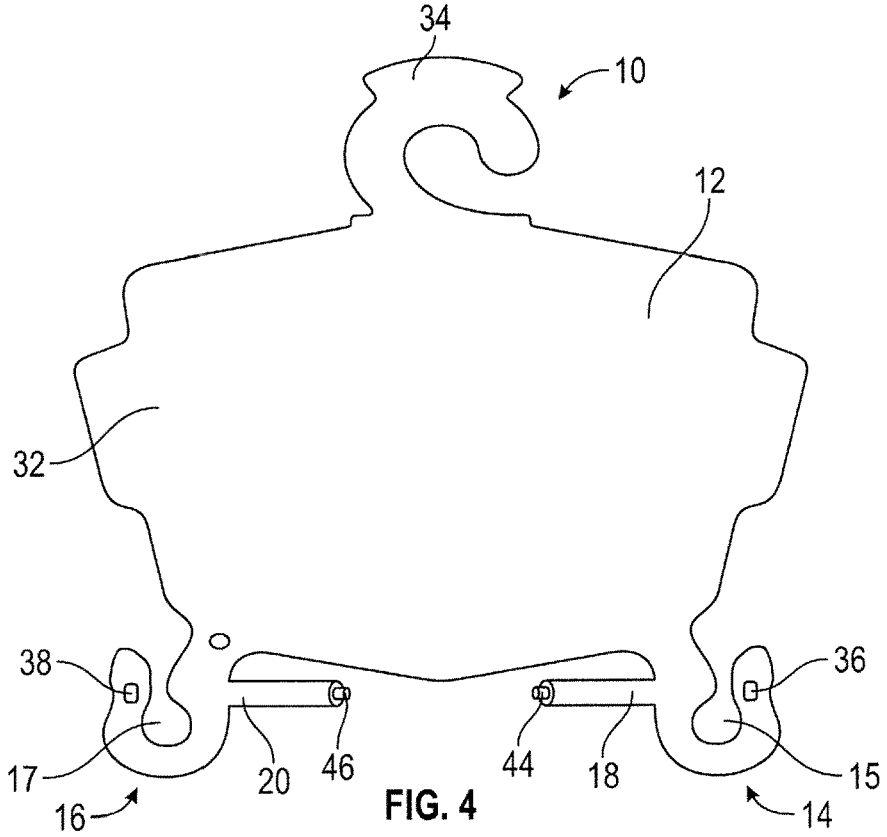
FIG. 4 is a rear view of the footwear security display hanger in FIG. 2.
Figure 5:
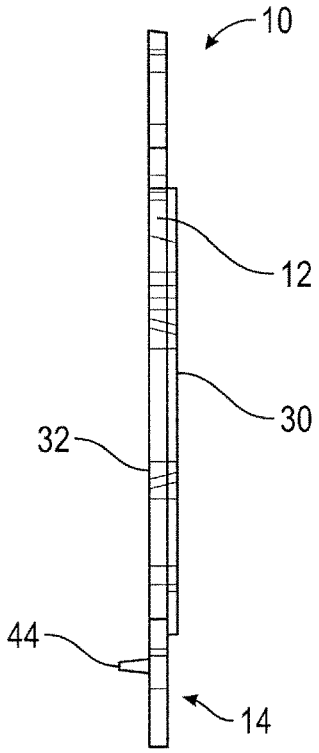
FIG. 5 is a side view of the footwear security display hanger in FIG. 2.

According to an embodiment of the present invention, referring to FIGS. 1-9, a footwear security display hanger 10 includes a body member 12, first and second hooks 14, 16, and first and second locking arms 18, 20. The first and second locking arms 18, 20 are connected to the first and second hooks 14, 16, respectively, and repositionable relative thereto between unlocked/open (FIGS. 2-5) and locked/closed (FIGS. 6-9) positions. The footwear security display hanger 10 is configured to engage and secure a variety of different footwear products 22 with a thong or a strap 24 such as flip-flops or sandals, as shown in FIG. 1.

Referring more particularly to FIGS. 2-5, the body member 12 is generally flat and includes a first end 26, a second end 28, and first and second sides 30, 32 extending between the first and second ends 26, 28. A display hanger hook 34 is positioned at the first end 26 to provide a means to engage with a display hook for retail display.

Each of the first and second hooks 14, 16 is integrally connected to the body member 12 and extends downwardly from each corresponding side portion of the second end 28 of the body member 12. The first and second hooks 14, 16 include a first open-ended hook cavity 15 and a second open-ended hook cavity 17, respectively, which a portion, such as the thong 24, of the footwear product 22 can be placed and engaged therewithin. First locking aperture 36 and second locking aperture 38 are defined at a first front hook portion 40 of the first hook 14 and a second front hook portion 42 of the second hook 16, respectively, through which first and second locking devices 44, 46 can be inserted, as will be described in greater details below.

The first locking arm 18 and the second locking arm 20 extend longitudinally from a first rear hook portion 48 of the first hook 14 and a second rear hook portion 50 of the second hook 16, respectively, with each of the rear hook portions 48, 50 integrally connected to the body member 12. Each of the first and second locking arms 18, 20 includes a foldline 52, such as crease, to allow each locking arm 18, 20 to be movable or folded along the foldline 52 to overlie the first and second open-ended hook cavities 15, 17 and lock the first and second hooks 14, 16 to close the open-ended hook cavities 15, 17. The first and second locking devices 44, 46 are formed integrally from the first locking arm 18 and second locking arm 20, respectively, and extend perpendicularly therefrom. The first and second locking devices 44, 46 are designed and configured to be inserted through corresponding locking aperture 36, 38 to provide a locking mechanism, as illustrated in FIGS. 6-9, to prevent the footwear product 22 from being removed from the first and second hooks 14, 16.

Figure 6:
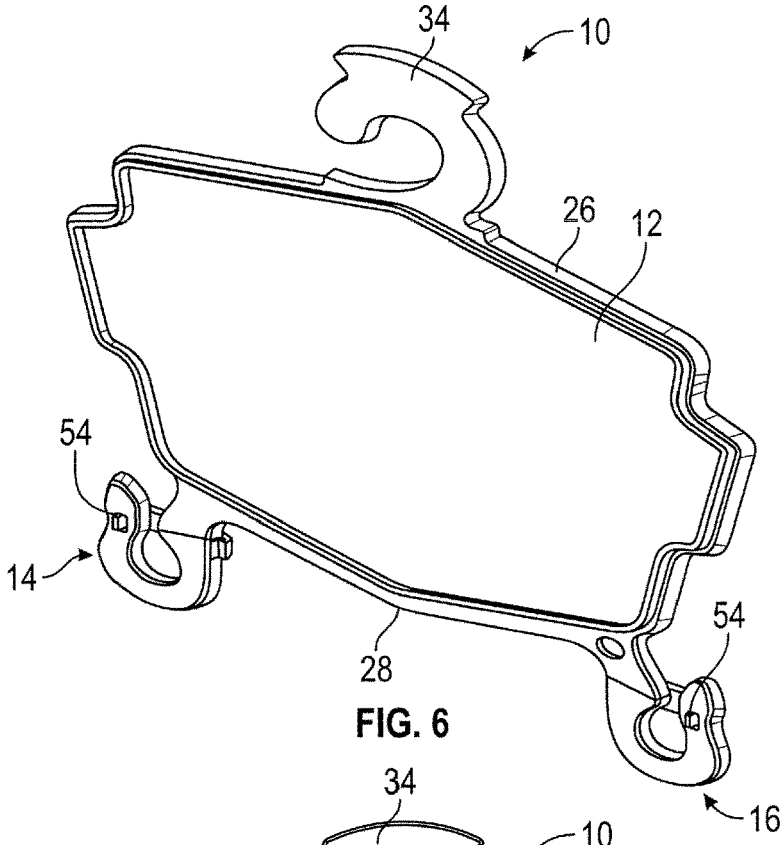
FIG. 6 is a perspective front view of the footwear security display hanger in FIG. 2 in a locked or closed position.
Figure 7:
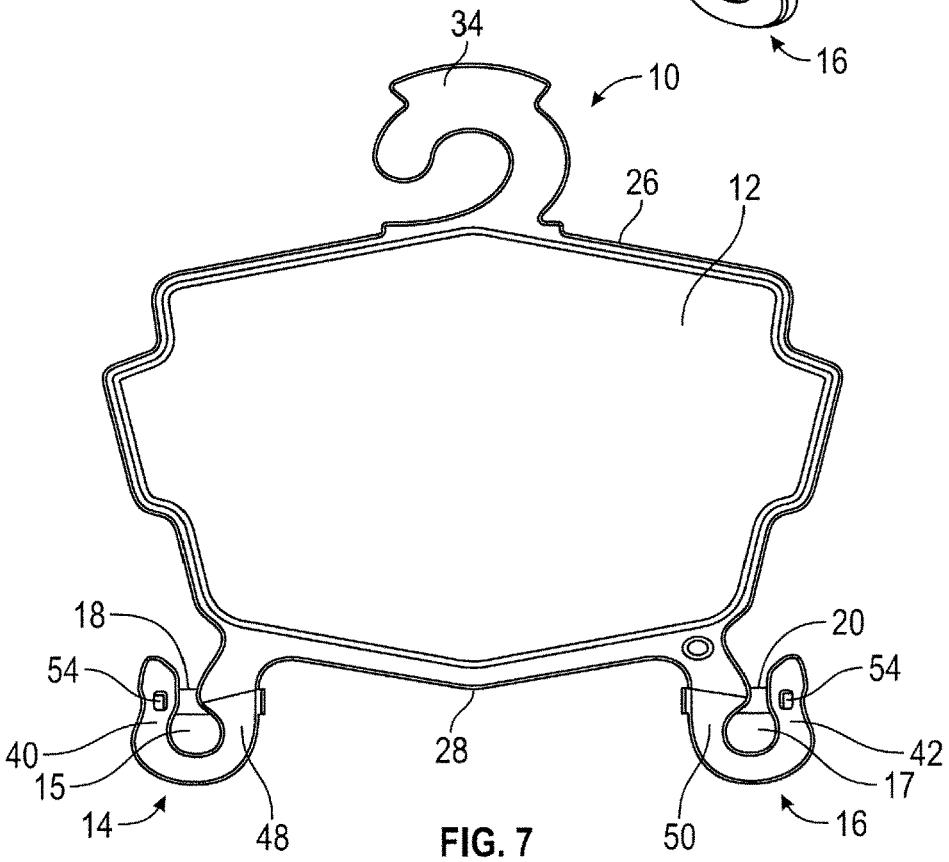
FIG. 7 is a front view of the footwear security display hanger in FIG. 6.
Figure 8:
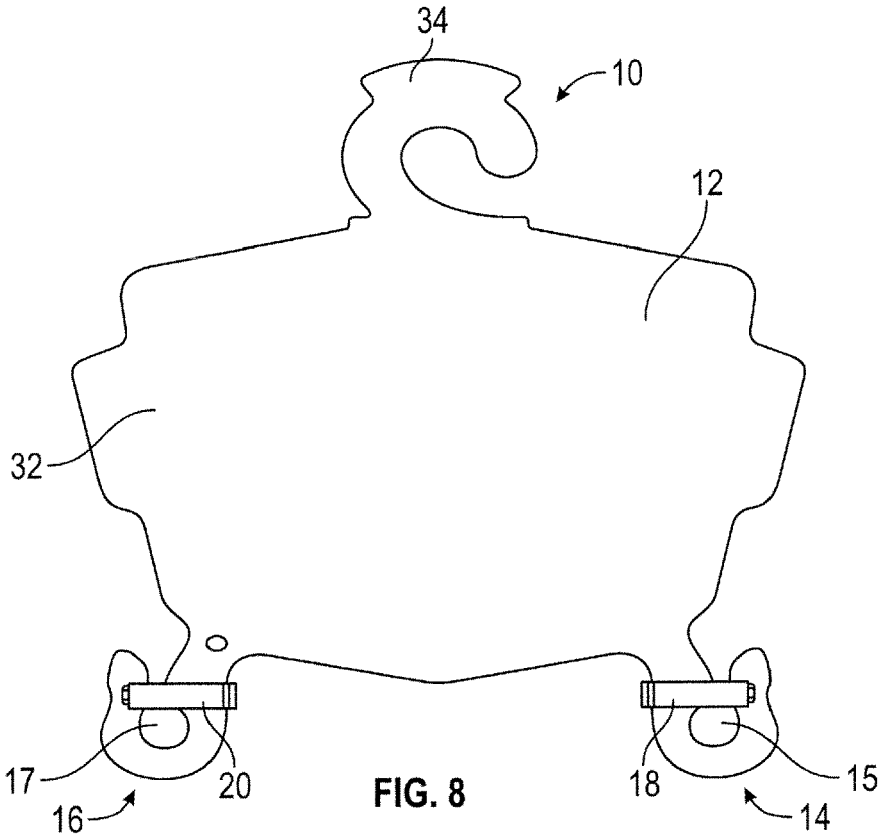
FIG. 8 is a rear view of the footwear security display hanger in FIG. 6.
Figure 9:
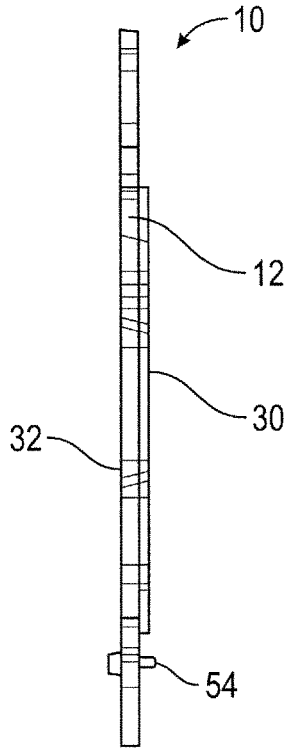
FIG. 9 is a side view of the footwear security display hanger in FIG. 6.

Contours of the first and second locking apertures 36, 38 and the first and second locking devices 44, 46 are configured such that, when engaged, they provide a locking mechanism, with each tip 54 of the first and second locking devices 44, 46 protruding outwardly from each of the first and second locking apertures 36, 38, as shown in FIGS. 6 and 7. Once the footwear security display hanger 10 is in the locked/closed position, it is extremely difficult to open it with bare hands to separate the footwear 22 from the footwear security display hanger 10. In fact, the locked footwear security display hanger 10 is not readily openable without destruction of the display hanger 10.

It is contemplated that a security tag or marker (not shown) may be applied to the first or second side 30, 32 of the body member 12. In addition to the security tag, the first and second sides 30, 32 of the body member 12 provide convenient surfaces for pictures such as logos or text (including product descriptions) to be printed on, embossed in, or otherwise attached.

The security tag attached to the footwear security display hanger 10 has a wide variety of uses, including tracking, inventory control, and security. The security tag can also provide electronically readable information pertaining to the footwear product 22. The security tag is a radio frequency identification (RFID) tag, an electronic article surveillance (EAS) device or the like. The security tag is firmly secured to the footwear security display hanger 10 such that it remains with the footwear product 22 until after the time of purchase.

The footwear security display hanger 10 is made out of one or more materials having suitable properties for a desired application, including strength, weight, rigidity, etc. Plastic is generally preferred. It will be appreciated that other designs and configurations could be used for the body member 12, as deemed suitable for given application factors.

In use of the footwear security display hanger 10, first, in the unlocked/open position, the footwear products 22, such as flip-flops, are engaged with the first and second hooks 14, 16 by inserting the thong 24 of each of the flip-flops 22 through the opening of each of the first and second hooks 14, 16. Then, by folding the first and second locking arms 18, 20 along the foldlines 52 and closing and locking the first and second locking arms 18, 20, the footwear security display hanger 10 is ready for suspension on a display hook or the like, such as a pegboard hook for retail display. Once a consumer purchases the footwear products 22, the consumer can remove it from the footwear security display hanger 10 by cutting along the foldlines 52 with scissors to allow the first and second locking arms 18, 20 to be open. Alternatively, the footwear products 22 can be removed from the footwear security display hanger 10 by cutting or clipping each tip 54 of the first and second locking devices 44, 46.

From the foregoing, it will be appreciated that a footwear security display hanger according to the present invention may be used to prevent mix-up of footwear products, as well as for anti-theft, tracking and inventory control, while providing the design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A footwear security display hanger comprising:

a generally flat body member having a first end, a second end, and first and second sides extending from the first and second ends;

first and second hooks integrally connected to the body member, the first and second hooks having a first open-ended hook cavity and a second open-ended hook cavity, respectively, for receiving a portion of footwear; and first and second locking arms connected to the first and second hooks, respectively;

wherein the first and second locking arms being movable to overlie the first and second open-ended hook cavities, respectively, and lock the first and second hooks to close the first and second open-ended hook cavities to prevent the footwear from being removed from the first and second hooks, wherein the first and second locking arms extend longitudinally from a first rear hook portion of the first hook and a second rear hook portion of the second hook, respectively, with each of the rear hook portions integrally connected to the body member.

2. The footwear security display hanger of claim 1, wherein each of the first and second hooks extends downwardly from each corresponding side portion of the second end of the body member.

3. The footwear security display hanger of claim 1, wherein each of the first and second locking arms includes a foldline to allow each of the first and second locking arms to be folded along the foldline to transition the footwear security display hanger between unlocked/open and locked/closed positions.

4. The footwear security display hanger of claim 1, wherein the body member includes a display hanger hook on the first end to engage with a display hook for retail display.

5. The footwear security display hanger of claim 1, wherein the first and second sides of the body member extend between the first end and the second end.

6. The footwear security display hanger of claim 1, wherein the footwear security display hanger is made out of plastic.

7. The footwear security display hanger of claim 1, further comprising a security tag, which is attached to the body member.

8. The footwear security display hanger of claim 7, wherein the security tag is used for tracking, inventory control, and security.

9. The footwear security display hanger of claim 7, wherein the security tag is a radio frequency identification (RFID) tag or an electronic article surveillance (EAS) device.

10. A footwear security display hanger comprising:

a generally flat body member having a first end, a second end, and first and second sides extending from the first and second ends;

first and second hooks integrally connected to the body member, the first and second hooks having a first open-ended hook cavity and a second open-ended hook cavity, respectively, for receiving a portion of footwear; and first and second locking arms connected to the first and second hooks, respectively;

wherein the first and second locking arms being movable to overlie the first and second open-ended hook cavities, respectively, and lock the first and second hooks to close the first and second open-ended hook cavities to prevent the footwear from being removed from the first and second hooks, wherein a first locking aperture and a second locking aperture are defined on the first hook and the second hook, respectively, wherein a first locking device and a second locking device are formed integrally from the first and second arms, respectively, and are designed and configured to engage with the first and second locking apertures to provide a locking mechanism to prevent the footwear from being removed from the first and second hooks.

11. The footwear security display hanger of claim 10, wherein the first and second locking apertures are defined at a first front hook portion of the first hook and a second front hook portion of the second hook, respectively, through which the first and second locking devices could be inserted.

12. A footwear security display hanger comprising:

a generally flat body member having a first end, a second end, and first and second sides extending from the first and second ends;

first and second hooks integrally connected to the body member, the first and second hooks having a first open-ended hook cavity and a second open-ended hook cavity, respectively, for receiving a portion of footwear; and first and second locking arms connected to the first and second hooks, respectively;

wherein the first and second locking arms being movable to overlie the first and second open-ended hook cavities, respectively, and lock the first and second hooks to close the first and second open-ended hook cavities to prevent the footwear from being removed from the first and second hooks, wherein a first locking aperture and a second locking aperture are defined on the first hook and the second hook, respectively, wherein a first locking device and a second locking device are formed integrally from the first and second arms, respectively, wherein contours of the first and second locking apertures and the first and second locking devices are configured such that, when engaged, they provide a locking mechanism, with each tip of the first and second locking devices protruding outwardly from each of the first and second locking apertures.

* * * * *